US006093291A

United States Patent [19]

Izumi et al.

[11] Patent Number: 6,093,291

[45] Date of Patent: Jul. 25, 2000

[54] ELECTROPLATING APPARATUS

[75] Inventors: Takayuki Izumi; Takehiko Okajima, both of Tokyo, Japan

[73] Assignee: Oki Electric Industry Co., Ltd., Tokyo, Japan

[21] Appl. No.: 09/126,845

[22] Filed: Jul. 31, 1998

[30] Foreign Application Priority Data

Sep. 2, 1997 [JP] Japan ..... 9-237297

[51] Int. Cl.[7] ..... C25D 17/00; C25B 9/00; C25B 11/00

[52] U.S. Cl. ..... 204/224 R; 204/275; 204/284

[58] Field of Search ..... 204/224 R, 275, 204/284

[56] References Cited

U.S. PATENT DOCUMENTS 5,228,966 7/1993 Murata ..... 204/284 X
5,391,285 2/1995 Lytle ..... 204/284 X
5,443,707 8/1995 Mori ..... 204/284 X
5,514,258 5/1996 Brinket et al. ..... 204/284 X

*Primary Examiner*—Donald R. Valentine
*Attorney, Agent, or Firm*—Jones Volentine, L.L.P

[57] ABSTRACT

An electroplating apparatus is made up of a cup having a plating solution therein, a plating solution controlling unit which overflows the plating solution from the cup, a holding unit which holds an object to be plated so as to contact to the overflowed plating solution, and a mesh shaped anode electrode provided in an internal portion of the cup, the mesh shaped anode electrode having a surface comprising a metal which are plated by the plating solution. Accordingly, the electroplating apparatus can get the plated film having a smooth surface.

10 Claims, 6 Drawing Sheets

ELECTROPLATING APPARATUS

BACKGROUND OF THE INVENTION

1. Field of the invention:

The present invention generally relates to an electroplating apparatus, and more particularly, the present invention relates to the electroplating apparatus for plating a semiconductor wafer.

This application is a counterpart of Japanese application Serial Number 237297/1997, filed Sep. 2, 1997, the subject matter of which is incorporated herein by reference.

2. Description of the Related Art:

In general, a fountain type electroplating apparatus has been used for plating a semiconductor wafer. The fountain type electroplating apparatus is made up of a wafer holder cup which is supplied a plating solution from below, a plating bath which collects the plating solution overflowed from the wafer holder cup, and a holding unit which holds an object to be plated so as to contact to the overflowed plating solution. A mesh shaped anode electrode is provided in an internal portion of the wafer holder cup. A constant current flows between the mesh shaped anode electrode and the holding unit when a plating occurs. The conventional fountain type electroplating apparatus has been used an anode electrode which plated platinum (Pt) on a mesh shape titanium (Ti).

In the conventional fountain type electroplating apparatus, it is desirable to decrease a thickness distribution of plating on an object to be plated.

SUMMARY OF THE INVENTION

An object of the present invention is to provide an electroplating apparatus that can get the plated film having a smooth surface.

According to one aspect of the present invention, for achieving the above object, there is provided an electroplating apparatus comprising: a cup having a plating solution therein; a plating solution controlling unit which overflows the plating solution from the cup; a holding unit held an object to be plated so as to contact to the overflowed plating solution; and a mesh shaped anode electrode provided in an internal portion of the cup, the mesh shaped anode electrode having an upper surface comprising a metal which is plated by the plating solution.

According to another aspect of the present invention, for achieving the above object, there is provided an electroplating apparatus comprising: a cup having a plating solution therein; a plating solution controlling unit which overflows the plating solution from the cup; a holding unit held an object to be plated so as to contact to the overflowed plating solution; and a mesh shaped anode electrode provided in an internal portion of the cup, the mesh shaped anode electrode having opening portions which are formed in 65% area thereof.

According to another aspect of the present invention, for achieving the above object, there is provided an electroplating apparatus comprising: a cup having a plating solution therein; a plating solution controlling unit which overflows the plating solution from the cup; a holding unit held an object to be plated so as to contact to the overflowed plating solution; and a mesh shaped anode electrode provided in an internal portion of the cup, the mesh shaped anode electrode comprising a diamond shape meshes which has two diagonal lines with respective lengths of 6 mm and 3.2 mm.

BRIEF DESCRIPTION OF THE DRAWINGS

While the specification concludes claims particularly pointing out and distinctly claiming the subject matter that is regarded as the invention, the invention, along with the objects, features, and advantages thereof, will be better understood from the following description taken in connection with the accompanying drawings, in which:

DETAILED DESCRIPTION OF THE PREFERRED EMBODIMENTS

An electroplating apparatus according to a preferred embodiment of a present invention will hereinafter be described in detail with reference to FIG. 1, FIG. 2, FIG. 3, FIG. 4, FIG. 5, FIG. 6, FIG. 7, FIG. 8, FIG. 9, and FIG. 10.

Figure 1:
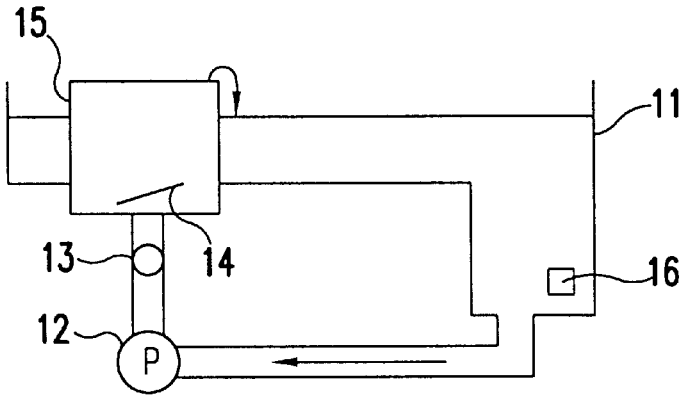
FIG. 1 is a diagram showing a fountain type electroplating apparatus according to a preferred embodiment of a present invention.
Figure 2:
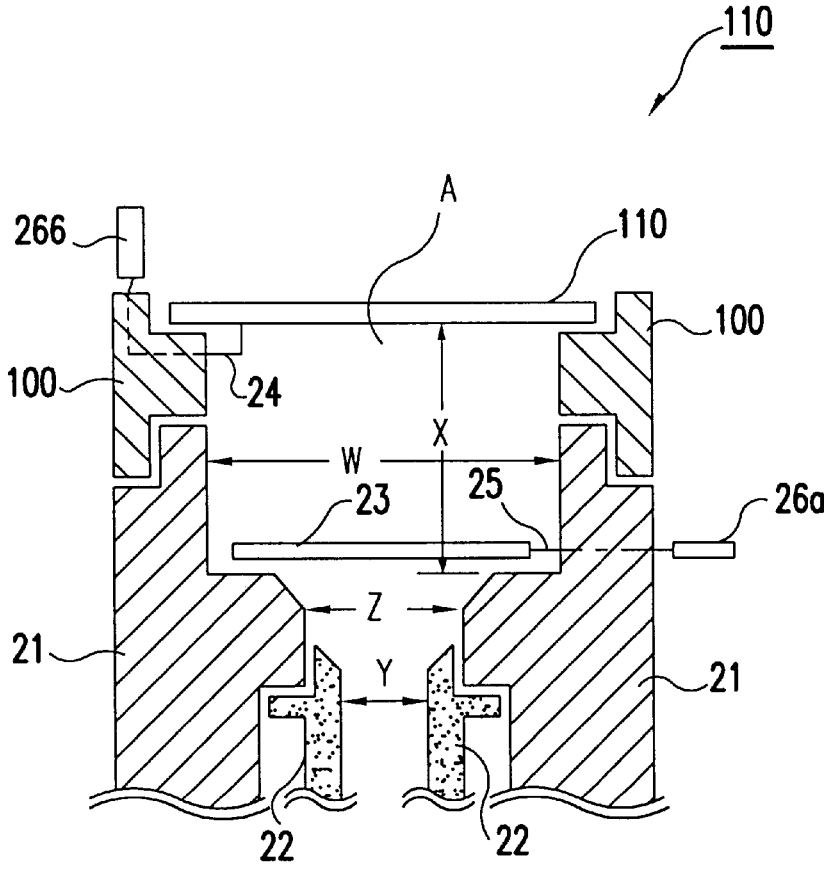
FIG. 2 is a diagram showing a wafer holder of a fountain type electroplating apparatus according to a preferred embodiment of a present invention.

FIG. 1 is a diagram showing a fountain type electroplating apparatus according to a preferred embodiment of a present invention. FIG. 2 is a diagram showing a wafer holder of a fountain type electroplating apparatus according to a preferred embodiment of a present invention.

As shown in FIG. 1, the fountain type electroplating apparatus is preferably made up of a plating bath 11, a jet pump 12, a flow rate sensor 13, a baffle plate 14, and a wafer holder 15. The plating bath 11 stores a plating solution, and has a temperature adjusting unit 16 for constantly maintaining a desired temperature of the plating solution. The jet pump 12 pumps the plating solution up to the wafer holder 15, and rotates the plating solution throughout the fountain type electroplating apparatus (both the plating bath 11 and the wafer holder 15) by overflowing the plating solution from the wafer holder 15 according to a control unit (not shown). In this circumstance, the control unit controls the jet pump 12 so as to rotate the plating solution with a flow rate designated by an operator, in response to an output of the flow rate sensor 13 which is used for measuring a flow rate of the plating solution. The baffle plate 14 is used for rectifying a flow of the plating solution.

As shown in FIG. 2, the wafer holder 15 is preferably includes a wafer holder cup 21, an anode electrode 23, and a cathode pin 24. The wafer holder cup 21 has an upper space A with an internal diameter of W and a length of X. In the preferred embodiment, W is 72 mm and X is 60 mm. The baffle plate 14 (shown in FIG. 1) locates below the upper space A and the adapter 22. The adapter 22 has a internal diameter of Y. In the preferred embodiment, Y is 18 mm. A plurality of the cathode pins 24 are located so that one end of the respective cathode pins 24 slightly projects from the wafer holder cup 21 and so that other end of the respective cathode pins 24 is connected to a cup electrode 26*b*, in an upper portion of the wafer holder cup 21. Here, FIG. 2 shows one of the cathode pins 24. The anode electrode 23 is connected to one end of the anode pin 25 and is located in a bottom portion of the upper space A. The other end of the anode pin 25 is located in a portion that a cup electrode 26*a* is not contacted to the plating solution.

The wafer holder 15 has a holding unit 100 which is used for holding an object to be plate, for example a semiconductor wafer 110, a size of 3 inchs, in the manner of uncovering the upper space A. In this circumstance, the wafer is located so as to contact to the plating solution filled up the wafer holder cup 21 and the cathode pin 24. When a plating occurs, the semiconductor wafer 110 is held on the wafer holder cup 21 by the holding unit 100, then a constant current from a plating power supply voltage is supplied between the cup electrodes 26*a* and 26*b*.

Figure 3:
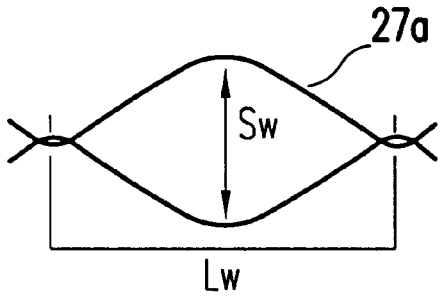
FIG. 3 is a first plan view showing a method for forming an anode electrode according to a preferred embodiment of a present invention.
Figure 4:
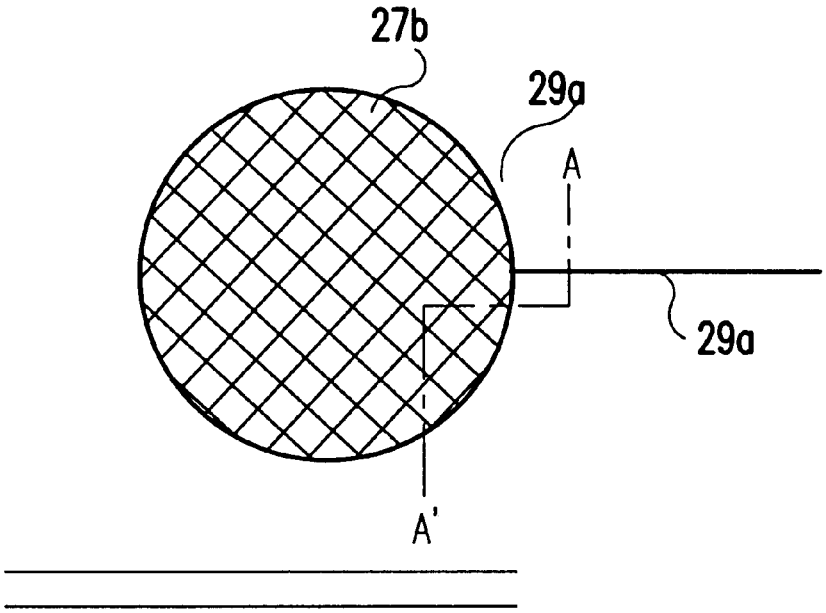
FIG. 4 is a second plan view showing a method for forming an anode electrode according to a preferred embodiment of a present invention.
Figure 5:
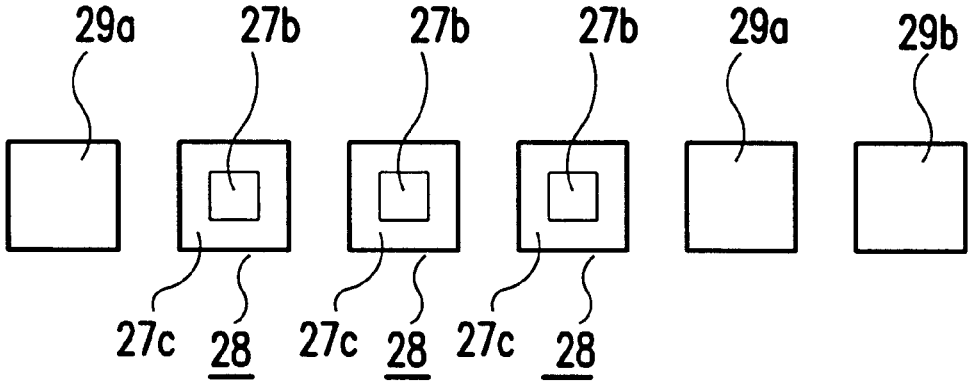
FIG. 5 is a first partially sectional view taken on line A–A' of FIG. 4.
Figure 6:
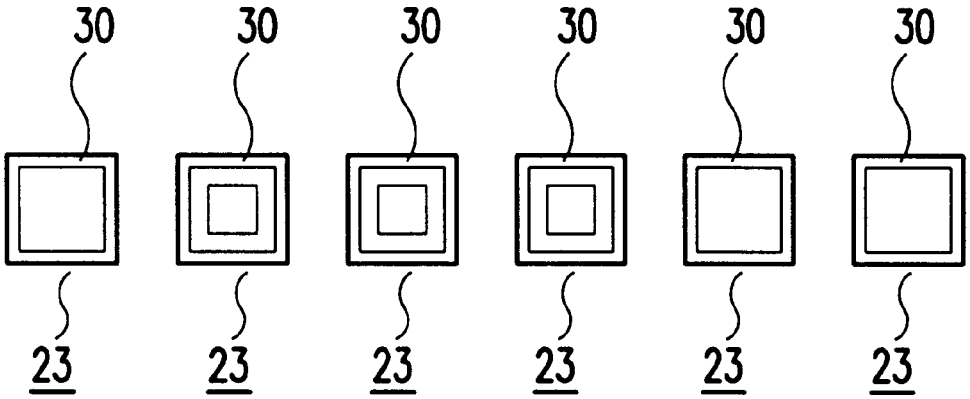
FIG. 6 is a second partially sectional view taken on line A–A' of FIG. 4.

FIG. 3 is a first plan view showing a method for forming an anode electrode according to a preferred embodiment of a present invention. FIG. 4 is a second plan view showing a method for forming an anode electrode according to a preferred embodiment of a present invention. FIG. 5 is a first partially sectional view taken on line A–A' of FIG. 4. FIG. 6 is a second partially sectional view taken on line A–A' of FIG. 4.

The anode electrode 23 is formed as follows.

As shown in FIG. 3, a titanium (Ti) mesh 27*b* is formed by combining a plurality of diamond shape meshes. The respective diamond shape meshes is formed by a titanium (Ti) wire 27*a* of 1 mm square, which have two diagonal lines with a length of Lw and a length of Sw. In the preferred embodiment, Lw is 6.0 mm and Sw is 3.2 mm. Then, as shown in FIG. 4 and FIG. 5, a platinum (Pt) layer 27*c* having a thickness of about 2 $\mu$m, is formed on the Ti mesh 27*b* using a plating, and as a result a plated Ti mesh 28 is formed. Then, Pt wires 29*a* and 29*b* are stretched on the periphery of the plated Ti mesh 28. Then, as shown in FIG. 6, a plating solution which is used when the wafer 110 is plated, which is plated on the both surfaces of the Pt wires 29*a* and 29*b* and the plated Ti mesh 28. In the preferred embodiment, it is a gold plating solution (Newtronex309 manufactured by EEJA). As a result, gold (Au) 30 as a plating metal layer, a thickness of 2 $\mu$m, is formed on the both surfaces of the Pt wires 29*a* and 29*b* and the plated Ti mesh 28. Therefore, the plating solution plated on an upper surface of the anode electrode 23 is the same as a predetermined plating solution to plate on the wafer.

The anode electrode 23 is formed using the forming steps as mentioned above.

Next, an experiment result for the fountain type electroplating apparatus of the preferred embodiment of the invention will be described. The experiment carried out with both of the anode electrode of the preferred embodiment of the invention and the conventional anode electrode. In the conventional anode electrode, Ti mesh is formed by combining a plurality of diamond shape meshes. The respective diamond shape meshes is formed with a Ti wire of 1 mm square, which have two diagonal lines with lengths of 6.4 mm and 12.7 mm. Then, Pt having a thickness of about 2 $\mu$m is electroplated on the Ti mesh. Thus, the conventional anode electrode is formed.

For experimentation with a stability of repeated use of the fountain type electroplating apparatus, thickness distributions of electroplated metal layers measured and changes of voltages applied during an electroplating step between the cup electrodes 26*a* and 26*b* were measured when Au electroplating steps were repeated. Here, Au is used as the plating solution (Newtronex309 manufactured by EEJA). A temperature of the plating solution is 50° C. A constant current flows between the cup electrodes 26*a* and 26*b* so that current density is 2 mA/cm2. A flow rate of the plating solution is set so that a flow velocity of the plating solution in an upper portion of the wafer holder cup 21 is about 1.3 cm/s.

Figure 7:
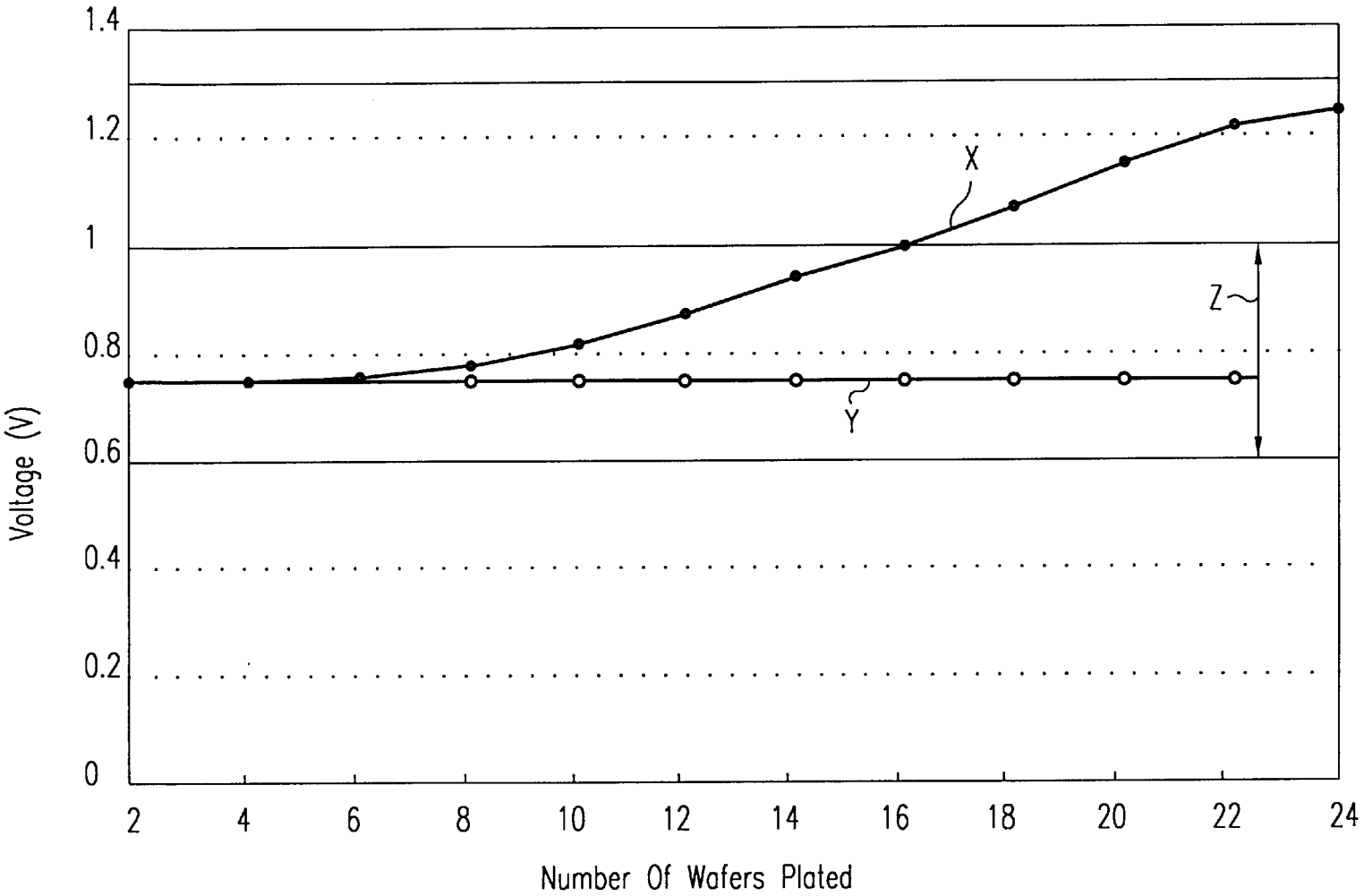
FIG. 7 is a first graph showing a stability of repeated use of the fountain type electroplating apparatus.
Figure 8:
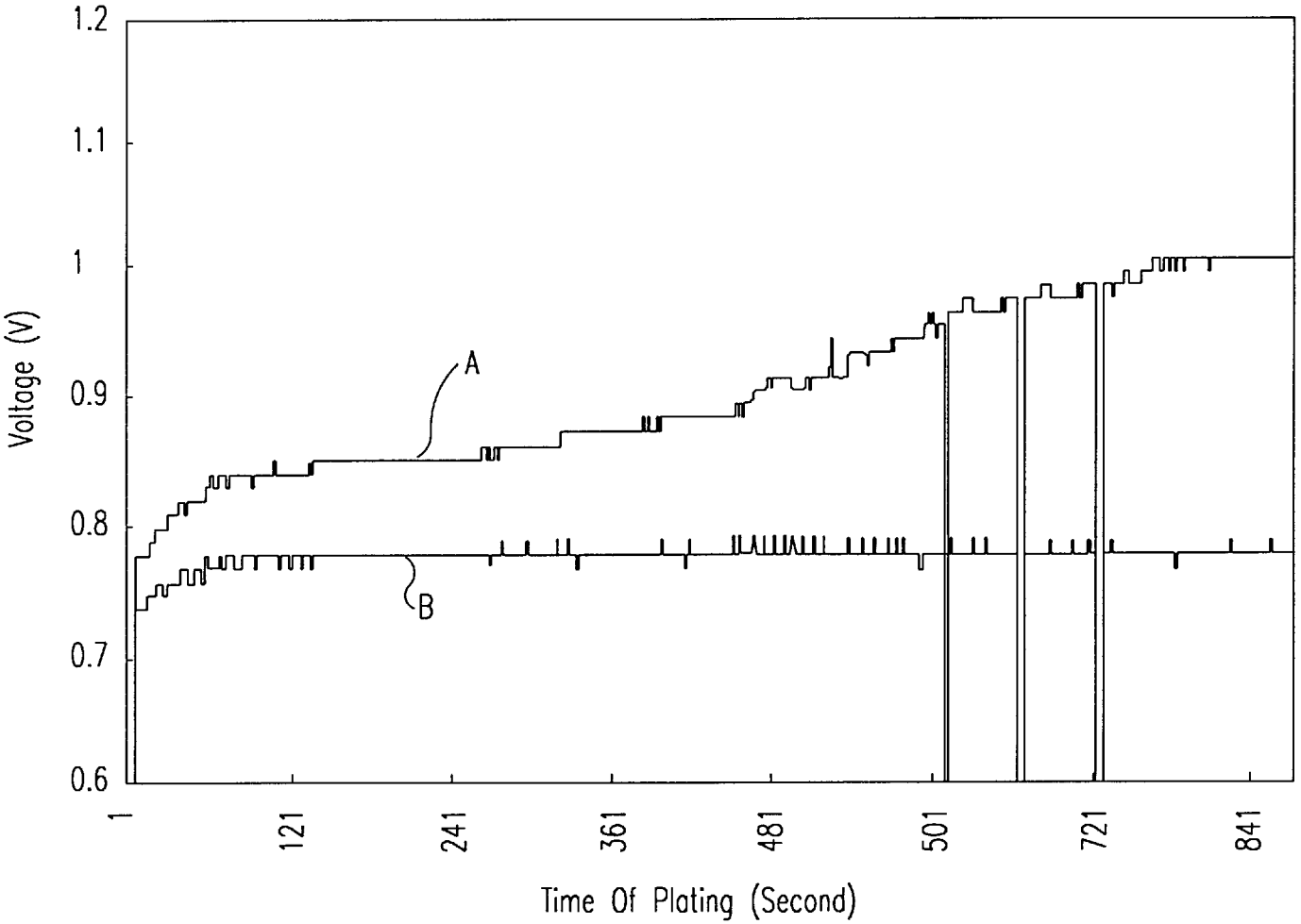
FIG. 8 is a second graph showing a stability of repeated use of the fountain type electroplating apparatus.

FIG. 7 is a first graph showing a stability of repeated use of the fountain type electroplating apparatus. Particularly, FIG. 7 shows dependence on the number of use of the largest voltages applied during a plating step between the cup electrodes 26*a* and 26*b*. FIG. 8 is a second graph showing a stability of repeated use of the fountain type electroplating apparatus. Particularly, FIG. 8 shows a time change of voltages applied during a plating step for one wafer between the cup electrodes 26*a* and 26*b*.

As shown by a line X of FIG. 7, the largest voltage of the conventional fountain type electroplating apparatus rapidly increase each time. When 24 plating step of the 24 wafers terminated, the largest voltage was 1.3 V. This result is the same as a voltage value applied without locating the anode electrode 23 between the cup electrodes 26*a* and 26*b*.

As shown by a line A of FIG. 8, in the conventional fountain type electroplating apparatus, voltages applied between the cup electrodes 26*a* and 26*b* show unusual results in several times as the number of plating steps increase. Further, until sixteen times in a measurement result of a thickness distribution, the conventional fountain type electroplating apparatus can form a wafer having a sufficient thickness distribution referring to the standard. That reason that an electric field distribution disorders by an anodic oxidation proceeds on the anode electrode while the plating steps is repeated. As a result, the plated metal layers having bad thickness distributions are formed.

On the other hand, as shown by a line Y of FIG. 7, in the fountain type electroplating apparatus according to the preferred embodiment of the invention, all plated metal layers satisfied the standard through the 24 plating steps. Further, the largest voltages hardly change through the 24 plating steps. Further, as shown by a line B of FIG. 8, the unusual voltage values hardly occur during the plating steps. The reason for is that the anodic oxidation hardly proceeds on the anode electrode while the plating steps is repeated. As a result, the plated metal layers having bad thickness distributions are not formed.

Figure 9:
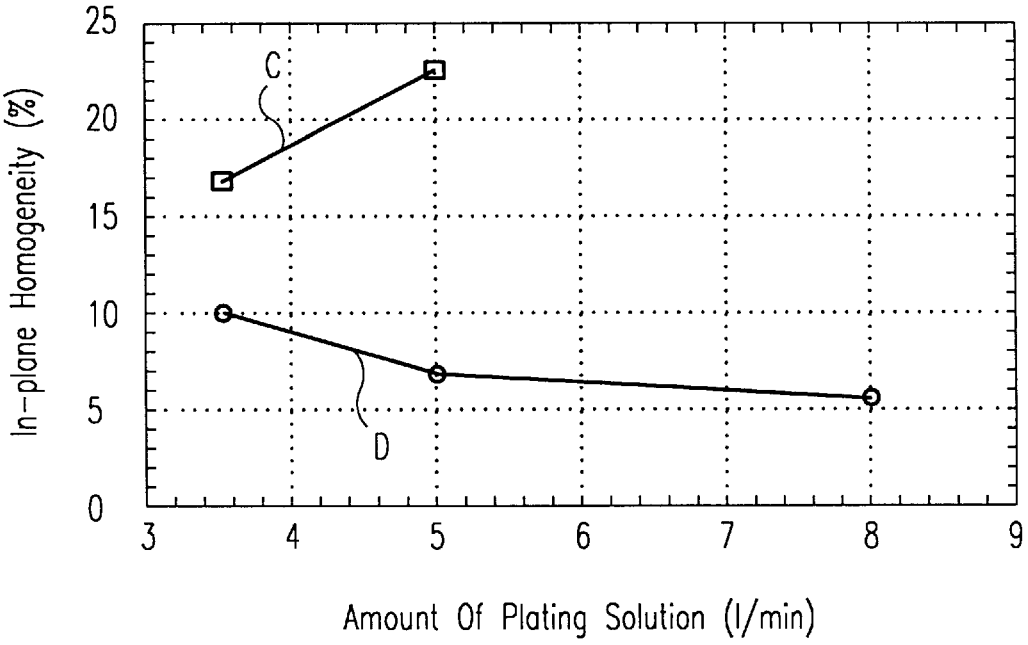
FIG. 9 is a graph showing a dependence on an electroplating flow rate for an in-plane homogeneity of the plating film formed by the fountain type electroplating apparatus according to the preferred embodiment of the invention.

FIG. 9 is a graph showing a dependence on an plating flow rate for an in-plane homogeneity of the plating film formed by the fountain type electroplating apparatus according to the preferred embodiment of the invention.

Here, the in-plane homogeneity is shown by the ratio of a−b to a+b using a percentage. (where a is a maximum thickness and b is a minimum thickness)

This experiment was carried out with both of the anode electrode of the preferred embodiment of the invention and the conventional anode electrode. In the conventional anode electrode, Ti mesh is formed by combining a plurality of diamond shape meshes. The respective diamond shape meshes is formed with a Ti wire of 1 mm square, which have two diagonal lines with lengths of 6.4 mm and 12.7 mm. Then, Pt and Au having a respective thickness of about 2 $\mu$m are plated on the Ti mesh. Thus, the conventional anode electrode is formed. The conventional anode electrode is a large-mesh compared to the preferred embodiment of the invention. In the fountain type electroplating apparatus having the conventional anode electrode with the large-mesh, when setting to the amount of the plating solution of 3.5 l/min (the flow velocity of the plating solution of 1.3 cm/s), an Au plated film with the in-plane homogeneity of 16% is formed. When setting to the amount of the plating solution of 5.0 l/min (the flow velocity of the plating solution of 1.8 cm/s), an Au plated film with the in-plane homogeneity of 23% is formed (as shown by a line C of FIG. 9).

On the other hand, in the fountain type electroplating apparatus having the anode electrode according to the preferred embodiment of the invention, when setting to the amount of the plating solution of 3.5 l/min (the flow velocity of the plating solution of 1.3 cm/s), an Au plated film with the in-plane homogeneity of 10% is formed. When setting to the amount of the plating solution of 8.0 l/min (the flow velocity of the plating solution of 2.9 cm/s), an Au plated film with the in-plane homogeneity of less 6% is formed (as shown by a line D of FIG. 9).

Further, in the fountain type electroplating apparatus having the mesh smaller than the anode electrode according to the preferred embodiment of the invention, when setting to the amount of the plating solution of 3.5 l/min (the flow velocity of the plating solution of 1.3 cm/s), an Au plated film with the in-plane homogeneity of 16% is formed.

Figure 10:
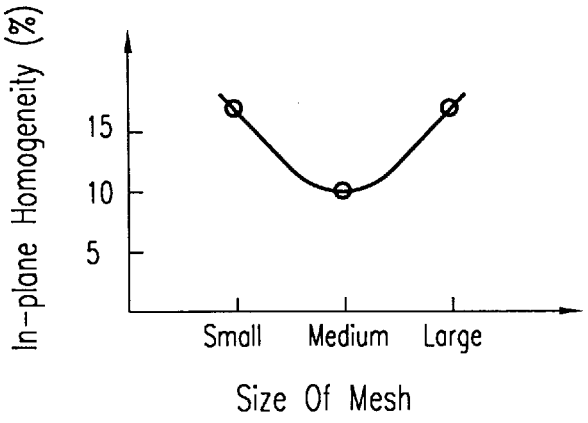
FIG. 10 is a graph showing a dependence on the mesh size the anode electrode for an in-plane homogeneity of the plating film formed by the fountain type electroplating apparatus according to the preferred embodiment of the invention.

FIG. 10 is a graph showing a dependence on the mesh size the anode electrode for an in-plane homogeneity of the plating film formed by the fountain type electroplating apparatus according to the preferred embodiment of the invention.

As shown in FIG. 10, the fountain type electroplating apparatus having the anode electrode according to the preferred embodiment of the invention can get a good result for the in-plane homogeneity compared to the fountain type electroplating apparatuses having the anode electrodes with the large-mesh and the small-mesh.

As mentioned above, the fountain type electroplating apparatus according to the preferred embodiment of the invention can get the plated film having a smooth surface compared to the conventional fountain type electroplating apparatus. Further, the fountain type electroplating apparatus according to the preferred embodiment of the invention hardly need to make a exchange the anode electrode, and therefore it can stably form the good plated film. Accordingly, it can efficiently plate the object to be plated.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is therefore contemplated that the appended claims will cover any such modifications or embodiments as fall within the true scope of the invention.

What is claimed is:

1. An electroplating apparatus comprising:

a cup adapted to contain a plating solution therein;

a plating solution controlling unit adapted to overflow the plating solution from the cup;

a holding unit adapted to hold an object to be plated so as to contact the overflowed plating solution; and a mesh shaped anode electrode provided in an internal portion of the cup, the mesh shaped anode electrode having an upper surface comprising a metal which is plated by the plating solution, the mesh shaped anode electrode having opening portions which are formed in 65% area thereof.

2. An electroplating apparatus as claimed in claim 1, further comprising an electrode structure adapted to flow a current between the object and the mesh shaped anode electrode.

3. An electroplating apparatus as claimed in claim 1, wherein the mesh shaped anode electrode is comprised by forming an upper surface layer comprising a metal plated by the plating solution, on a surface of a combination structure of a mesh shaped member and an anode pin to connect between the mesh shaped member and a power supply voltage for plating.

4. An electroplating apparatus as claimed in claim 3, wherein the anode pin comprises a lead wire.

5. An electroplating apparatus as claimed in claim 1, wherein the plating solution controlling unit is adapted to set a flow velocity of the plating solution such that a flow velocity of the plating solution flowing upward when the plating solution overflows from the cup is 1.3~3 cm/s.

6. An electroplating apparatus comprising:

a cup adapted to contain a plating solution therein;

aplating solution controlling unit adapted to overflow the plating solution from the cup;

a holding unit adapted to hold an object to be plated so as to contact the overflowed plating solution; and a mesh shaped anode electrode provided in an internal portion of the cup, the mesh shaped anode electrode having an upper surface comprising a metal which is plated by the plating solution, the mesh shaped anode electrode having opening portions which are formed in 65% area thereof, and the mesh shaped anode electrode having a diamond shaped mesh which has two diagonal lines with respective lengths of 6 mm and 3.2 mm.

7. An electroplating apparatus as claimed in claim 6, further comprising an electrode structure adapted to flow a current between the object and the mesh shaped anode electrode.

8. An electroplating apparatus as claimed in claim 6, wherein the mesh shaped anode electrode is comprised by forming an upper surface layer comprising a metal plated by the plating solution, on a surface of a combination structure of a mesh shaped member and an anode pin to connect between the mesh shaped member and a power supply voltage for plating.

9. An electroplating apparatus as claimed in claim 8, wherein the anode pin comprises a lead wire.

10. An electroplating apparatus as claimed in claim 8, wherein the plating solution controlling unit is adapted to set a flow velocity of the plating solution such that a flow velocity of the plating solution flowing upward when the plating solution overflows from the cup is 1.3~3 cm/s.

* * * * *